US008695576B2

(12) United States Patent
Zadra

(10) Patent No.: US 8,695,576 B2
(45) Date of Patent: Apr. 15, 2014

(54) TEMPORARY PROJECTILE RETAINING APPARATUS AND RELATED METHODS

(76) Inventor: Lawrence J. Zadra, Laguna Hills, CA (US)

( * ) Notice: Subject to any disclaimer, the term of this patent is extended or adjusted under 35 U.S.C. 154(b) by 1518 days.

(21) Appl. No.: 11/884,405

(22) PCT Filed: Feb. 15, 2005

(86) PCT No.: PCT/US2005/004603

§ 371 (c)(1),
(2), (4) Date: Aug. 15, 2007

(87) PCT Pub. No.: WO2006/088443

PCT Pub. Date: Aug. 24, 2006

(65) Prior Publication Data

US 2008/0156308 A1 Jul. 3, 2008

(51) Int. Cl.
*F41B 3/02* (2006.01)

(52) U.S. Cl.
USPC ..... 124/20.1; 124/44.6

(58) Field of Classification Search
USPC ..... 124/20.1, 20.2, 44.6; 335/303
See application file for complete search history.

(56) References Cited

U.S. PATENT DOCUMENTS

| | | | | |
|---|---|---|---|---|
| 2,735,417 | A * | 2/1956 | Denekar | 124/20.1 |
| 3,124,725 | A * | 3/1964 | Leguillon | 335/303 |
| 3,184,807 | A * | 5/1965 | Schornstheimer et al. | 49/478.1 |
| 4,794,905 | A * | 1/1989 | Woolard | 124/5 |
| 5,072,715 | A * | 12/1991 | Barr | 124/20.1 |
| 5,095,831 | A * | 3/1992 | Mauzy | 102/448 |
| 5,413,547 | A * | 5/1995 | Cole et al. | 482/121 |
| 5,438,972 | A * | 8/1995 | Harbin | 124/27 |
| 2006/0172103 | A1 * | 8/2006 | Chang | 428/40.1 |
| 2007/0218235 | A1 * | 9/2007 | Wu et al. | 428/40.1 |

* cited by examiner

*Primary Examiner* — John Ricci

(57) ABSTRACT

The present invention describes a slingshot apparatus having a pouch or similar type device, and/or wrist support/brace that is capable of temporarily retaining an object prior to launching the object. The slingshot assembly preferably includes a frame member, a pouch, and energy-storing and releasing members acting between the frame member and the pouch. In one embodiment, the pouch and/or wrist support preferably includes a magnetic force element capable of attracting an object to the pouch prior to launch of the object or projectile by the slingshot apparatus. Alternatively, the object to be launched includes a magnetic force element capable of attracting the pouch and/or wrist support prior to launch of the object by the slingshot apparatus. Related methods are described.

15 Claims, 7 Drawing Sheets

TEMPORARY PROJECTILE RETAINING APPARATUS AND RELATED METHODS

FIELD OF THE INVENTION

The present invention relates generally to slingshot apparatus and methods, and more specifically to a pouch and/or wrist support/brace for temporarily retaining a projectile prior to being launched by a slingshot assembly.

INCORPORATION BY REFERENCE

This is a National Stage application of International Patent Application No. PCT/US05/04603 filed on Feb. 15, 2005. The contents of each U.S. patent or other reference, if any, cited in this application, are hereby incorporated by reference.

BACKGROUND OF THE INVENTION

A wide variety of slingshot or similar projectile launching devices exist that are adapted to propel or launch an object. The launched objects can include things such as one or more pellets, pieces of shot, stones, paper clips, and water balloons, to name a few.

Commonly, these slingshot devices include pouches, constructed of leather or plastic, typically folded over the object or objects to be propelled. Typically, the object(s) must be held in place by friction and/or pressure exerted between the user's thumb and forefinger from the time that the objects are so "loaded" into the pouch or pocket until they are launched. In other words, the user typically must squeeze the objects to retain them in the slingshot pouch. Because the user's other hand is typically grasping or holding the slingshot handle, squeezing the loaded pouch leaves the user with both hands occupied. If done repeatedly or for an extended period of time, such as when a user has the slingshot "ready" or loaded, this can be cumbersome and/or tiring, especially for the user's "squeezing fingers". Among other consequences, the pellet or shot may inadvertently fall out of the pouch prior to launching.

SUMMARY OF THE INVENTION

The present invention is directed to a slingshot assembly having a pouch or similar type device and/or a wrist support/brace that is capable of temporarily retaining an object prior to launching the object, without requiring active user effort (such as squeezing the pouch closed). In one embodiment, the slingshot assembly preferably includes a frame member, a pouch, and an energy-storing and releasing member or members acting between the frame member and the pouch. The pouch and/or the wrist support (and/or the objects to be launched) preferably includes some means for "automatically" temporarily retaining within the pouch and/or wrist support the object or objects to be launched. In one embodiment, the temporary retention preferably is such that the user may quickly and easily grasp ammo from the wrist support, load the pouch, aim, and launch the objects.

For conventional metallic shot or other launchable objects (such as BBs), the "automatic" temporary retention can be provided by interacting magnetic forces. In one such embodiment, the magnet(s) can be imbedded or otherwise affixed to the pouch and/or wrist support in any suitable manner. Among alternative embodiments, the object to be launched can be magnetically charged, and the pouch and/or wrist support can include either an additional attracting magnet or simply a non-charged metallic or other element capable of attracting the magnetized objects prior to their launch.

Persons of ordinary skill in the art will understand that any suitable "attraction" force could be employed between the pouch and/or wrist support and the object(s) to be launched, so long as the attraction would not interfere with subsequent use of the slingshot. For example, the attraction between the pouch and the object(s) should be sufficiently strong to retain the objects in their desired temporary relationship with the pouch (prior to launch), but not so strong as to prevent the launch or negatively otherwise affect the user's ability to use the slingshot effectively. For embodiments using magnetic forces, the strength of the magnetic charge(s) can be selected according to the particular anticipated use of the slingshot.

Accordingly, regardless of which element (pouch, wrist support or projectile) is considered to include the magnetic force element, possesses the attractive force, and/or is attracted to the attractive force, the present invention preferably utilizes magnetic properties, preferably supplied by a magnet, to temporarily retain an object prior to being projected or launched by a slingshot assembly without the need for user effort or attention.

For the purpose of summarizing the invention, certain objects and advantages have been described. It is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages without necessarily achieving other objects or advantages as may be taught or suggested.

These and other embodiments will become readily apparent to those skilled in the art from the following detailed description of the preferred embodiments having reference to the attached figures, the invention not being limited to any particular preferred embodiment(s) disclosed.

DETAILED DESCRIPTION

Figure 1A:
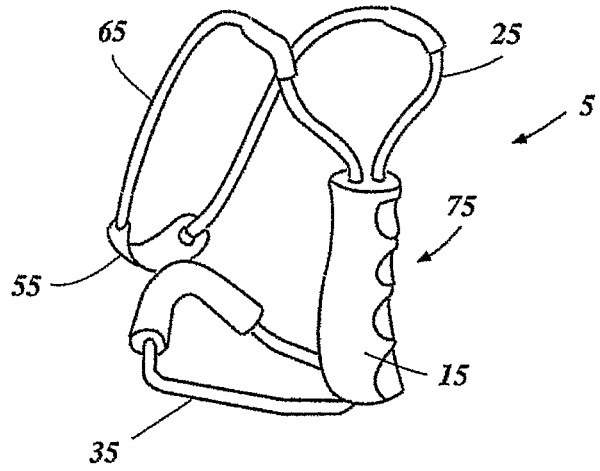
FIG 1A Prior Art
FIGS. 1A-B show prior art slingshot apparatus.

Embodiments of the present invention will now be described with references to the accompanying Figures, wherein like reference numerals refer to like elements throughout. The terminology used in the description presented is not intended to be interpreted in any limited or restrictive manner, simply because it is being utilized in conjunction with a detailed description of certain embodiments of the invention. Furthermore, various embodiments of the invention (whether or not specifically described) may include novel features, no single one of which is solely responsible for its desirable attributes or which is essential to practicing the invention described.

Figure 1B:
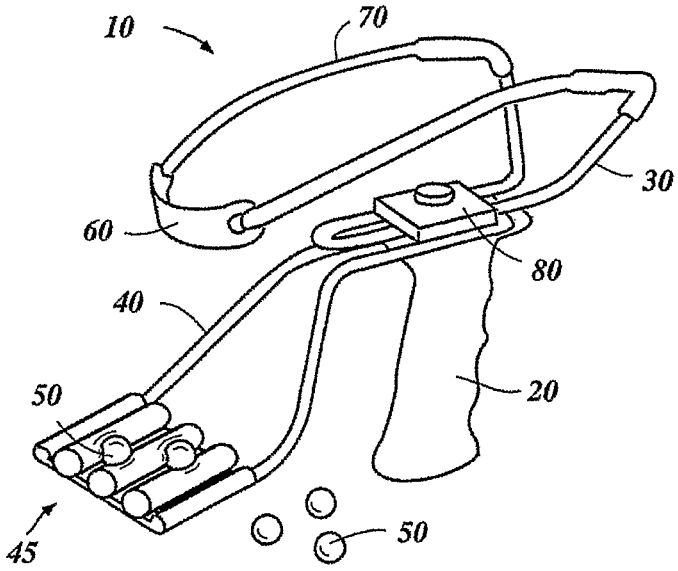
FIG 1B Prior Art

The general structure and operation of prior art slingshots such as those shown in FIGS. 1A-B are well known in the art and will only be discussed generally, to orient the reader with regard to the present invention. Prior art slingshots 5, 10 include a frame member consisting of a handle 15, 20, a yoke or fork 25, 30 having spaced apart prongs, and a wrist support/brace 35, 40. As shown in FIG. 1B, objects/projectiles 50 to be launched from the slingshot 5, 10 may be stored or carried by placing, pressing, snapping, fitting or otherwise positioning the objects 50 into or between troughs or rows 45 formed in the wrist support/brace 40.

The slingshot 5, 10 further includes a pouch 55, 60 connected to some type of energy storing-and-releasing elastic band(s) 65, 70 connected to the yoke 25, 30. The pouch 55, 60 is constructed of leather, cloth, rubber, neoprene, or a similar type flexible material. The user places the objects/projectiles 50 into the pouch 55, 60, grasps the loaded pouch and draws it back away from the yoke 25, 30 (storing energy in the elastic bands 65, 70), aims the device, and then releases the pouch (releasing the energy in the elastic bands 65, 70 and launching the objects/projectiles 50 through the yoke 25, 30 and toward the selected target.

Various pouch modifications have been proposed for temporarily retaining an object prior to being projected by the slingshot. For example, U.S. Pat. No. 4,274,387 issued Jun. 13, 1981 to McBride, shows a slingshot pouch designed with pleats that form a pocket for the placement of pellets or shot. Similarly, the slingshot pouch of U.S. Pat. No. 2,661,731 issued Jun. 4, 1951 to Casey, includes a pre-formed pocket to assist in pinching and holding projectiles until they are released when shot; and U.S. Pat. No. 3,618,585 issued Nov. 9, 1971 to Allison, shows a pouch or saddle with male and female Velcro™ tapes. Such pouches generally are designed (shaped and sized) for use with a range or particular type of object or projectile to be launched from the slingshot 5, 10.

Slingshots can shoot projectiles such as rocks or gravel or other objects, including metallic or other manufactured objects such as pellet(s), and/or shot 50. As used herein, the term "shot" is a broad term generally used in its ordinary meaning and will typically include, without limitation, a pellet or any similar type object such as ammunition suitable for use as a projectile.

Pellet(s) or shot 50 such as those utilized in prior art slingshots 5, 10 are well known in the art. They are usually round in shape, resembling a ball-bearing or BB, normally constructed of lead or polished steel, and are typically ¼ inch, 5/16 inch, or ⅜ inch in diameter. Alternatively, shot size may be referenced or characterized by a caliber designation such as .177 and .30 caliber. The shot 50 may further include light reflecting properties so that the shot acts as a "tracer" when launched from the slingshot 5, 10. Persons of ordinary skill in the art will understand that the invention can be practiced with a wide variety of shot, whether one of the conventional sizes or types just described or otherwise.

The energy-storing and releasing mechanism commonly is provided in the form of elastic band(s) 65, 70 or stretchable strap(s), typically constructed of some type of rubber tubing such as hollow surgical latex-tubing. As shown in the drawings, these may be attached to the yoke 25, 30, and configured to store energy when drawn away from the yoke 25, 30, and release the stored energy when propelled toward the yoke 25, to launch the pellet or shot 50 residing in the pouch 55, 60. Alternatively, the bands 65, 70 may be solid, like a rubber-band. They may also have other features, such as being tapered to decrease air resistance and increase velocity when released toward the yoke 25, 30.

The handle 15, 20, yoke 25, 30, and wrist support/brace 35, 40 are typically constructed of plastic, metal, wood, a composite substance, and/or a combination of the aforementioned materials. Persons of ordinary skill in the art will understand that any suitably strong material can be used. As shown in FIG. 1A, the handle 15 may include contoured or molded finger grooves 75 or a pistol type grip for user comfort and stability of the slingshot 5. As further shown in FIG. 1B, the handle 20 may be further adapted to allow forward and aft adjustment 80 of the attached wrist support 40 and/or yoke 30 to increase or decrease the elastic band 70 draw length for various shooting needs, and may even contain a pellet or shot 50 storage compartment (not shown).

Many other prior art slingshot features are not shown in the drawings (including, for example, adjustable sights, weighted stabilizers, an ammo dispenser, a carrying strap, and foldable or collapsible elements), which may be used in various embodiments of the invention.

Similar to those prior art slingshots mentioned above, the present invention preferably includes a frame member constructed to provide a suitable platform for launching projectiles, and energy-storing and releasing means such as elastic/rubber bands attached to the frame. As indicated above, the invention can be practiced or used in a wide variety of embodiments, including with the addition of other elements that may be attached, connected, affixed, positioned on, or otherwise associated with the frame member to further facilitate projectile launching or provide some other ancillary function. Other elements include a yoke, an elastic band, a carrying strap, and/or ammunition (pellets or shot) similar to those used in the prior art slingshots mentioned above, among others.

Because the preferred frame, and yoke of the present invention are generally known in the prior art, for simplicity the reference designations corresponding to those elements have been excluded in the drawings, as each of those elements may be representatively found in either FIG. 1A and/or FIG. 1B. Persons of ordinary skill in the art will understand, however, that as FIGS. 1A-B represent only a portion of the prior art, and that those undesignated elements of the present invention should not be limited to the specific structure, construction, and/or function as shown or conveyed in FIGS. 1A-B. Instead, as indicated above, the invention can be practiced with a wide variety of configurations and assemblies and methods.

For simplicity, temporary magnetic retaining capability and structure is described herein as relating to a pouch 85 and projectile 50. However, those same temporary magnetic retaining properties, which exist between the pouch 85 and projectile 50 (regardless of which element (pouch or projectile) is considered to include the magnetic force element, possess the attractive force, and/or is attracted to the attractive force), apply equally to temporary magnetic retaining capability and structure between a wrist support/brace 41 and the projectile 50.

One embodiment of the pouch of the invention is illustrated in FIGS. 2(*a*)-(*c*). In one embodiment, the slingshot apparatus of the present invention preferably includes a frame member 11 (such as, for example, the frame members of FIG. 1A or 1B); a pouch 85 (FIGS. 2(a)-(c)); and an energy-storing and releasing member, such as elastic bands formed form rubber or latex tubing, acting between the frame member 11 and the pouch 85 (see again FIG. 1A or 1B for examples).

As shown in FIGS. 2-5, the temporary projectile retaining device or pouch 85 may be generally rectangular in shape; constructed of leather, rubber, neoprene, nylon cloth, or similar type flexible material; and sized to generally accommodate the placement of one or more projectiles 50. The pouch 85 preferably includes at least one orifice or other connection means 90 positioned at each end or opposite sides of the pouch 85 to facilitate connection of the pouch 85 to the elastic bands. Persons of ordinary skill in the art will understand that attachment of the pouch 85 to the elastic bands may be accomplished by any suitable means, including (by way of example) by gluing or other adhesive methods, sewing, various welding techniques, as well as shrink-wrapping or other constriction methods such as tying-off.

The pouch 85 includes an attraction means to "temporarily" attract and/or hold the projectile to the pouch 85 prior to launch of the projectile by the slingshot. The "temporary" aspect indicates that the projectile preferably is held in an adjacent or abutting relationship with the pouch until being released from the "attraction" by normal operation of the slingshot launching procedure or otherwise being removed by the user (such as by manually pulling the projectile(s) off the pouch). The preferable attraction means is for use with one or more metallic projectiles (such as lead or polished steel shot or pellets), and is preferably a magnet capable of temporarily attracting the projectile or ammunition to the pouch 85 prior to launching it with the slingshot assembly. Although the present invention is primarily described utilizing steel or metallic shot, persons of ordinary skill in the art will understand that any materials possessing some magnetic or similar attraction characteristic may be utilized to provide the temporary attraction between the pouch and the projectile(s) in accordance with the invention.

As generally represented by the various different dotted lines in FIGS. 2-5, a single magnet 95 or a plurality of magnets 96(a)-(c) may be connected, affixed, operatively positioned, or otherwise associated with the pouch 85 by any suitable means. Among other things, this can be accomplished by various gluing, sewing, welding, and other attachment techniques, and certain methods or techniques may be preferable to others depending on the embodiment and the application in which the invention is to be used. The magnet (s) 95, 96(a)-(c) may be any suitable combination of shape, size, and/or magnetic strength, and may be operatively positioned at any suitable location to exert an attractive force on the object to be temporarily retained prior to being launched, projected, or otherwise propelled by the slingshot apparatus. The magnet can be flexible (see FIG. 2 for example) or solid. Preferably, the magnetic element is associated with the pouch in such a way that it remains so associated after the object has been launched, so that it is ready to receive and temporarily hold another object or objects for subsequent launch or use.

Temporary or assistive retention of an object prior to being launched (such as taught by the invention) has advantages for both casual and serious users of slingshots. Among other things, such temporary retention decreases the chance of the shot falling out of the pouch 85 during any point of use. For example, benefits of the invention can be enjoyed when the apparatus is "cocked" to fire, when the pouch is not even being held by a user, or when the firing mechanism is relaxed (such as when carrying, transporting, or otherwise holding the slingshot).

Furthermore, such temporary or assistance in retention of an object may help to improving shooting accuracy by decreasing any tendency the shot may have to wander or move around in the pouch 85. In other words, by positioning the shot routinely in generally the same position in the pouch 85 or by reducing the likelihood that it moves once it has been positioned, the magnetic attraction between the pouch 85 and the shot will tend to stabilize the shot so that the user or shooter may be able to more consistently rely on the sight alignment [relationship between the front sight (yoke) and rear sight (shot) to the aiming eye] resulting in increased shooting accuracy.

Figure 2A:
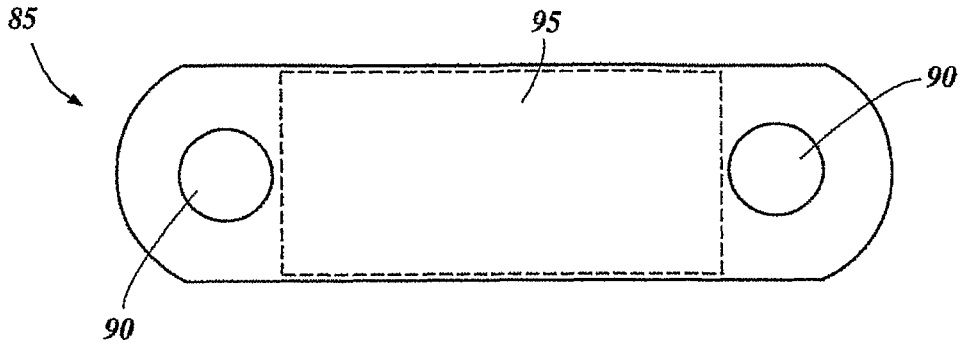
FIGS. 2(*a*)-(*c*) show one embodiment of a pouch or temporary projectile retaining device in accordance with the present invention.
Figure 2B:
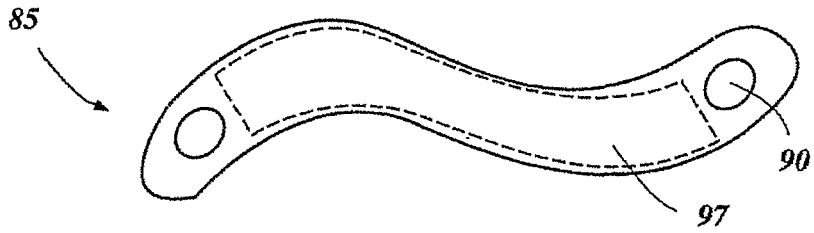
Figure 2C:
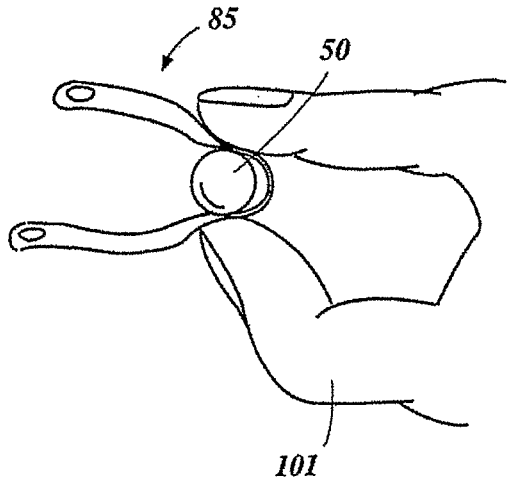
Figure 2D:
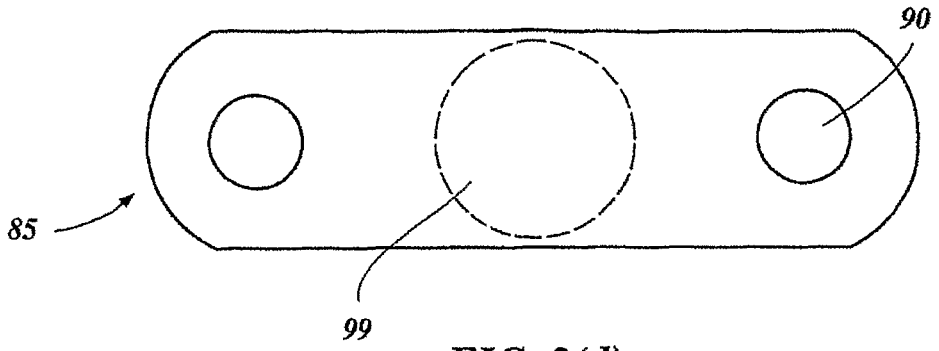
Figure 2E:
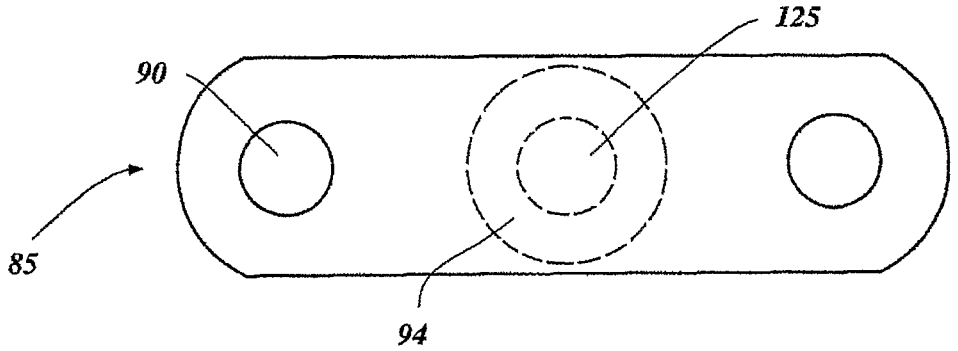
Figure 2F:
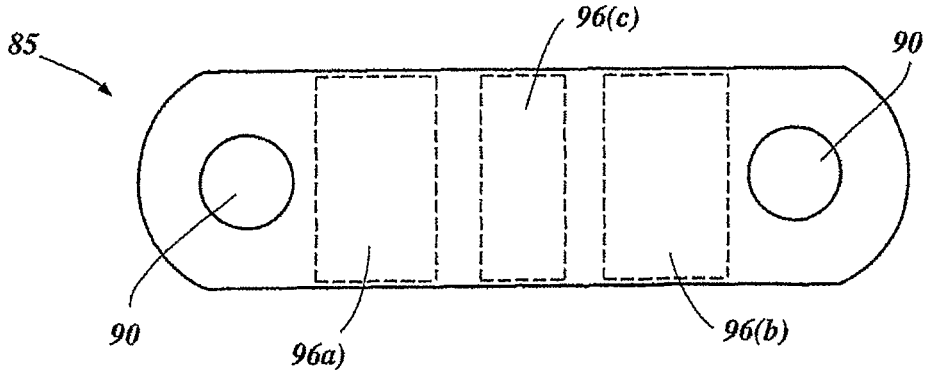
Figure 4:
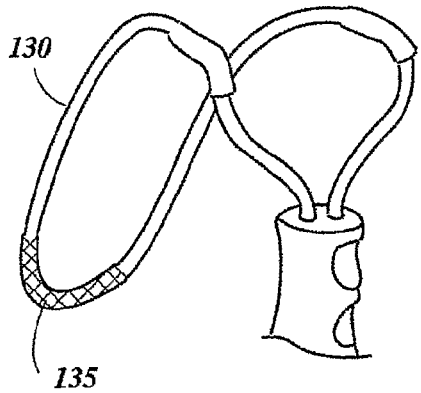
FIGS. 4(*a*)-(*b*) represent further alternative embodiments of the temporary projectile retaining device having an attraction/magnetic force element in accordance with the present invention.
Figure 5A:
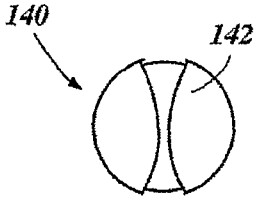
FIG. 5 shows a plurality of magnetic force elements operatively positioned on a temporary projectile retaining device in accordance with the present invention.
Figure 5B:
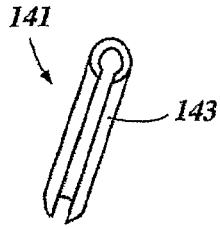

As shown in FIG. 2(a), in one embodiment, a majority or a significant portion of the pouch 85 may act as a magnet 95 to temporarily retain the projectile. As shown in FIGS. 2(b) and 2(c), similar to the magnets commonly found on household refrigerators to hold reminder notes, pictures, menus, etc., the pouch 85 would preferably be constructed of a lightweight flexible magnet 97 capable of being folded or otherwise manipulated by the user 101. In this example, some or all of the magnet 97 may be exposed and in direct contact with the object 50 to be launched from the pouch 85 (via holes in the pouch, not shown, or otherwise), or the magnet may be covered by the body of the pouch.

Although for any of the embodiments in the attached Figures the magnet can be mounted relatively permanently in or on the pouch, it can alternatively be provided in a removable and/or adjustable manner. "Permanent" and removable magnets can be used within a single assembly. The precise location and strength of the magnetic force can be selected for permanent or removable embodiments, and the removable versions also allow ready adjustment of the magnetic properties of the pouch.

Figure 3A:
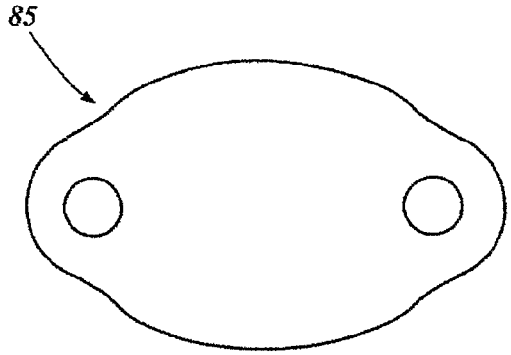
FIG. 3 is another example of a magnetic force element operatively associated with a temporary projectile retaining device in accordance with the present invention.
Figure 3B:
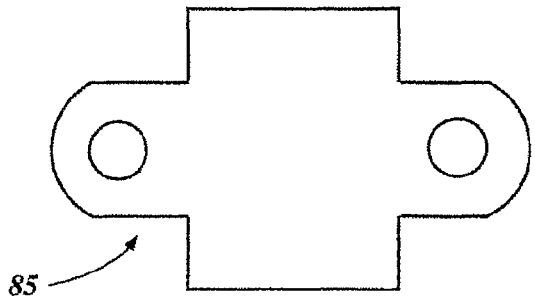
Figure 3:
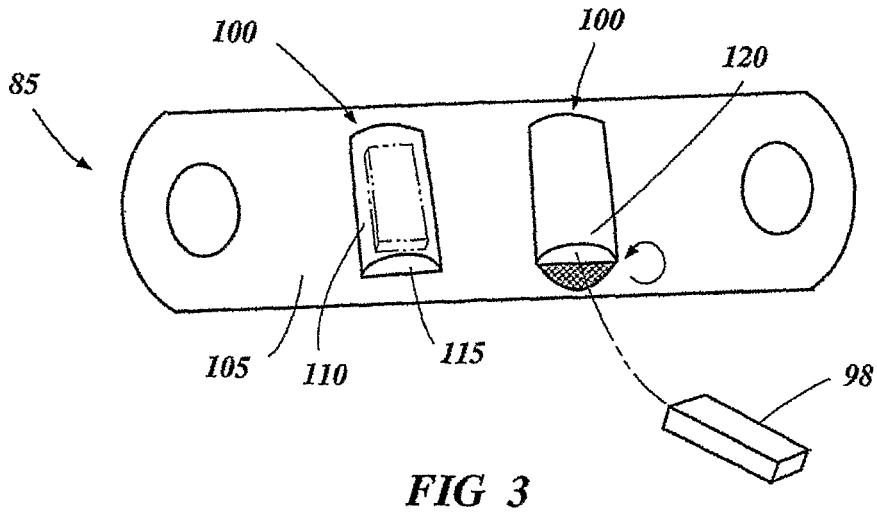

For example, in contrast to the pouch shown in FIG. 2(a), in another embodiment of the slingshot apparatus, the pouch 85 will preferably have at least one pocket 100 formed therein to receive at least one magnet 98, as shown in FIG. 3. In this regard, preferably two pieces of material 105, 110, such as those indicated above, may be connected together by well-known methods to form a pocket 100 to receive a magnet 98 positioned, between the layers of material. The shape of the pocket 100 will typically, but not necessarily, correspond to the shape of magnet 98. The pocket 100 may be sealed 115 by well-known methods to permanently house the magnet 98.

Alternatively, the pocket 100 may be left open on one or more sides to allow the magnet 98 to be removed. For some embodiments, friction or other interference-type fits may be sufficient or useful to retain the magnet in association with the pouch. Alternatively, a flap 120, or Velcro™, snap, zipper, button or any other suitable closure may be provided to temporarily secure within the pocket 100 and/or allow removal of one or more magnets 98 from the pocket 100. In this manner, one or more other magnets may replace one or more magnets in the pocket 100. As indicated above, the ability to remove and replace one magnet with another magnet within the open or resealable pouch architecture permits each temporary retaining device 85 to be magnetically customized accordingly to satisfy various shooting conditions and intended applications.

Figure 4A:
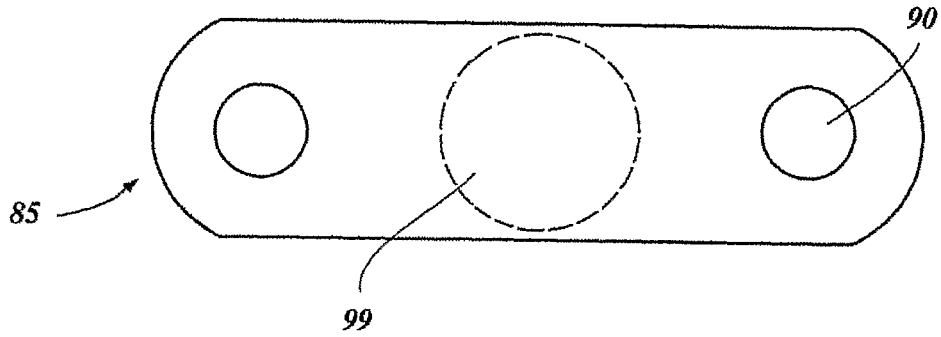
Figure 4B:
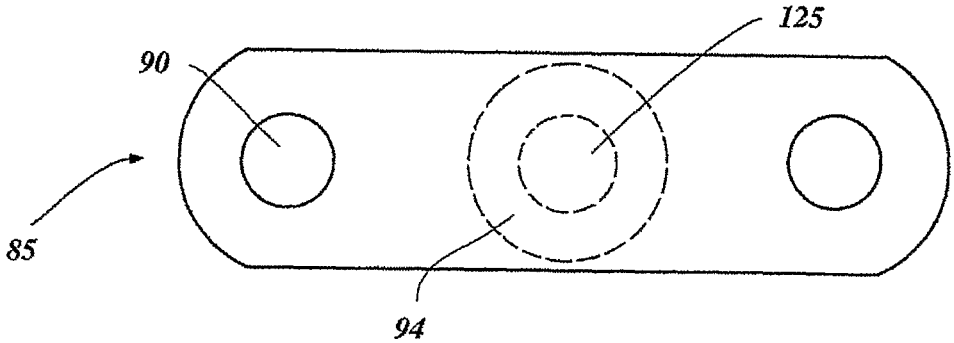

As shown in FIG. 2(a), a substantially rectangular magnet having a large surface area may be appropriate for temporarily retaining, or assisting in retaining, various projectiles or combinations of projectiles. Alternatively, as shown in FIG. 4(a), a substantially circular shaped magnet 99 having a relatively smaller surface area may be used. In still another embodiment, as shown in FIG. 4(b), a substantially circular shaped magnet 94 having an open well 125, where no magnet is present, may be suitable or useful. For any shape of magnet and/or patterns of magnets associated with the pouch, the strength of the magnets can be selected to provide the desired degree of "retention" force for the anticipated application and ammunition.

Persons of ordinary skill in the art will understand that the above examples are used for illustrative purpose only and are not intended to be interpreted in any limited or restrictive manner, simply because they are being utilized in conjunction with a detailed description of certain embodiments of the invention. Persons of ordinary skill in the art will further understand that the magnet(s) used in accordance with the present invention may encompass a wide range of shapes, sizes and strengths, and selection of each magnet variable may be unique and may depend on, among other things, the slingshot's application, ammunition and pouch characteristics, and the intended user.

Persons of ordinary skill in the art will understand that, if the magnetic force is too strong, the projectile may not be "released" or launched from the pouch, which would render the slingshot assembly ineffective.

Figure 5:
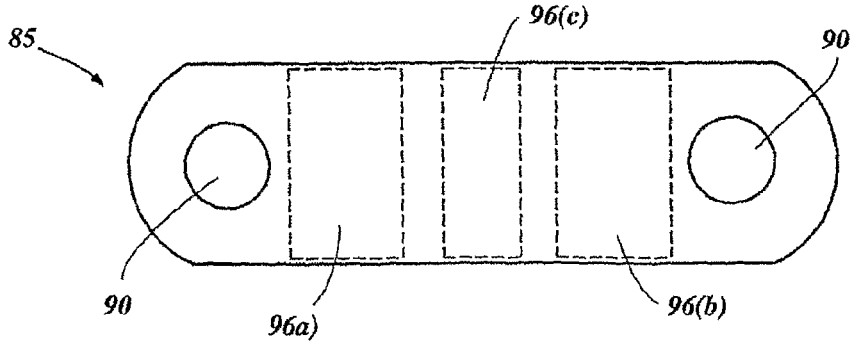

As shown in FIG. 5, a plurality of magnets 96(*a*)-(*c*) may be operatively affixed to the pouch 85 so as to exert a combined attractive force on an object or projectile. As indicated above, each of the plurality of magnets 96(*a*)-(*c*) may be substantially the same size, shape, and strength. Alternatively, one or more of the plurality of magnets 96(*a*)-(*c*) may differ from another magnet used in the same pouch in regard to one or more of the aforementioned magnet characteristics.

For example, as shown in FIG. 5, each magnet 96(*a*), 96(*b*), and 96(*c*) may be substantially the same shape (rectangular), but magnets 96(*a*) and 96(*b*) may be larger in one dimension (wider) than magnet 96(*c*). Magnet 96(*c*), however, may have a stronger magnetic attraction to certain metals than either magnet 96(*a*) or magnet 96(*b*). Alternatively, magnets 96(*a*) and 96(*b*) may have a greater magnetic strength, individually or combined, than magnet 96(*c*). In other words, magnet strength, size, shape, and operative positioning on the pouch 85 may vary according to factors described herein. Furthermore, magnets 96(*a*), 96(*b*), and 96(*c*), or any magnet used in accordance with the present invention, may be color coded, labeled, or otherwise marked to indicate, among other things, magnetic strength and/or desired positioning on the pouch 85.

Figure 6A:
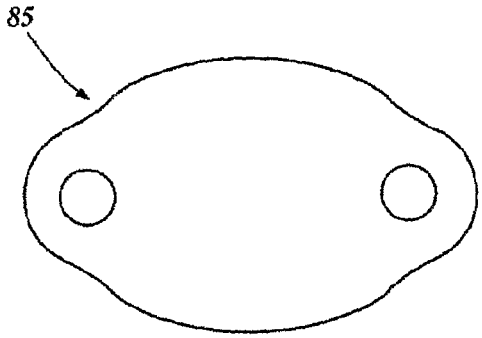
FIGS. 6(*a*)-(*b*) illustrate a few examples the many other alternative shapes available for a pouch or temporary projectile retaining device in accordance with the present invention.
Figure 6B:
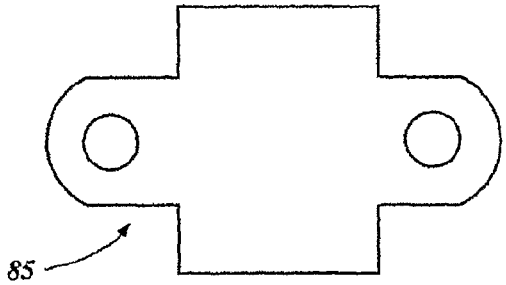

As shown in FIGS. 6(*a*)-(*b*) and as indicated above, the pouch 85, similar to the magnet(s) described herein, may have a variety of shapes. For example, as shown in FIG. 6(*a*), the pouch 85 may have a substantial lemon shape, or the pouch may be shaped similar to a cross, as shown in FIG. 6(*b*). Persons of ordinary skill in the art will understand that pouch shapes are virtually limitless and that each pouch, regardless of shape, preferably includes at least one magnetic force element (magnet) of some sort to temporarily retain or attract an object prior to being launched by the slingshot, as explained above.

Figure 7:
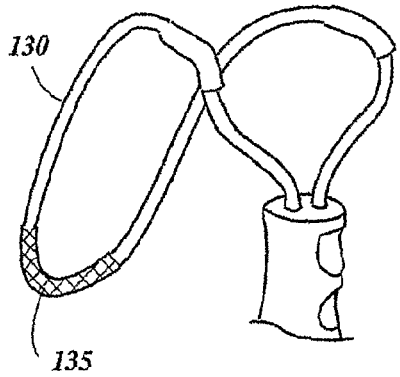
FIG. 7 shows yet another of the many embodiments of a slingshot assembly including a temporary projectile retaining device in accordance with the invention.

In another embodiment, as further shown in FIG. 7, the magnetic force element may be formed as part of the elastic band or tubing 130 or other energy storing and releasing mechanism used to facilitate launching of the projectile. As such, by acting as the projectile accepting surface, the tubing 130 would replace the "traditional" pouch. In this embodiment, if hollow elastic or latex tubing is used, a flexible magnetic force element 135 may be positioned within a tubing 130.

Alternatively, the magnetic force element, perhaps in the form of small magnetic pieces or particles, may be added during the tube forming process so as to be embedded or integrally formed with the tubing 130.

Figure 8A:
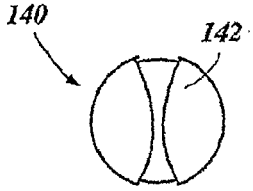
FIGS. 8(*a*)-(*b*) show a few examples of a magnet force element that may be used with the embodiment of at least FIG. 7.
Figure 8B:
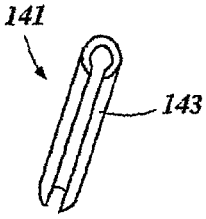

In still another embodiment, the magnetic force element is positioned around or operatively affixed to the outside of the tubing 130. Using a magnet 140, 141 similar to those shown in FIGS. 8(*a*)-(*b*) may facilitate positioning the magnet force element around the outside of the tubing 130. In one embodiment, the magnets 140, 141 preferably have a slit body 142, 143 similar in structure to the "sinkers" used by fisherman. The slit body 142, 143 permits the tubing 130 to be placed within the slit 142, 143 and the malleable magnet 140, 141 to be pressed closed around the tubing 130 to secure the magnet 140, 141 to the tubing 130. Such "external" magnets can be permanently (such as by gluing, etc.) or removably affixed to the elastic strap element 130.

Operatively affixing the magnet force element to the outside of the tubing 130 will generally allow the magnetic force element to be removed and replaced with a magnet force element having substantially the same characteristics (size, shape, magnetic strength), or a comparatively different magnetic force element(s) to permit each slingshot apparatus to be customized accord to the user's individual needs.

Such external magnets can alternatively or additionally be used with slingshots having "pouches", by mounting the external element on the strap at some point or points between the pouch and the handle/yoke. In such embodiments (not shown), the "non-pouch" magnet can be used to carry shot or pellets during lulls between shooting. If those magnets are sufficiently strong, they can even retain the shot/pellets through the course of actual shooting, and would be removed only by the user pulling them off of the magnet. Any such "strap mounted" magnets may affect the operation and aiming of the slingshot, but any effects in that regard may be addressed by balancing the two strap pieces (for example, with each strap having an identically-sized magnet along its length at the identical distance from the pocket).

In still another embodiment, not shown, rather than have the "magnetic force element" in the slingshot's pouch, the shot or projectile 50 may be magnetized and a metal plate may be operatively affix to the pouch 85. The various FIGS. 2-6 can also be considered in that regard, as they would appear similarly in the Figures whether the dashed/phantom areas are magnetic or metal. Accordingly, regardless of which element (pouch or projectile) is considered to include the magnetic force, possess the attractive force, and/or is attracted to the attractive force, the present invention preferably utilizes magnetic properties, typically supplied by a magnet, to temporary retain an object prior to being projected/launched by the slingshot.

Similar to the magnets previously mentioned in connection with the pouch 85, the shot 50 may have a wide variety of sizes and shapes (and magnetic strengths, for embodiments in which the shot is magnetized). Accordingly, when launched from the same slingshot drawn to approximately the same distance, shot of varying size, shape, and magnetic strength can display differing flight speed, distance, and penetrating depth characteristics, depending on the magnetic characteristics of the shot and/or pouch.

Figure 9:
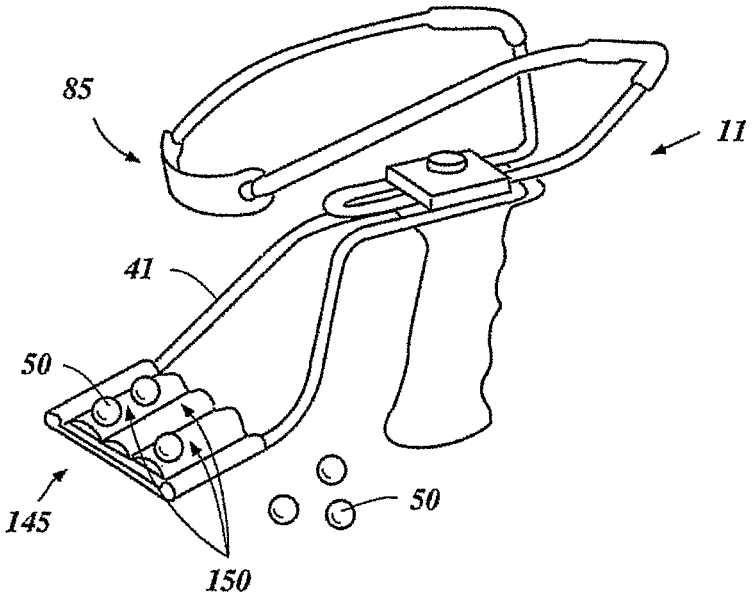
FIG. 9 shows one embodiment of a temporary retaining surface formed as part of a wrist support in accordance with the present invention.

As shown in FIG. 9, in another embodiment, magnetic properties may be used in association with a wrist support/brace 41 or any other suitable part of the slingshot 85 to temporarily retain objects 50. In this regard, a temporary projectile retaining surface 145 may be formed as part of the wrist support 41. As described herein with regard to the pouch 85, a single flexible piece of magnet material may form the retaining surface 145 of the wrist support 41, one or more magnets (not shown) may be positioned within one or more pockets 150 forming a portion of the retaining surface 145 of the wrist support 41, the projectiles may possess magnetic properties, or the wrist support/brace 41 and projectiles 50 may be oppositely charged.

The magnet(s) may be any suitable combination of shape, size, and/or magnetic strength, and may be operatively positioned at any suitable location to exert an attractive force on one or more object to be temporarily retained prior to being launched, projected, or otherwise propelled by the slingshot apparatus. As indicated above, the magnet can be flexible (see FIG. 2 for example) or solid. Preferably, the magnetic element is associated with the retaining surface 145 in such a way as to retain a plurality of objects 50 simultaneously. In this manner, the user potentially has a readily available supply of objects for continued or rapid fire launching of the object(s) 50. Accordingly, as one object 50 is launched from the slingshot apparatus the user simply removes another object 50 from the retaining surface 145, loads the object 50 into the pouch 85, and fires again. This process may be repeated as many times as there are objects on the retaining surface 145 of the wrist support 40.

In one embodiment, a method for temporarily retaining an object to be projected includes the steps of: (1) providing the slingshot apparatus as described herein, (2) positioning an object to be projected on the pouch having an attractive means operatively positioned thereon to temporarily attract the object to the pouch, (3) manipulating the energy-storing and releasing member so as to store energy in preparation of projecting the object, and (4) manipulating the energy-storing and releasing member so as to release the energy thereby projecting the object.

Alternative, the method and apparatus of temporarily retaining an object to be projected may include an attractive means operatively associated with the object to be projected or launched instead of being operatively positioned or associated with the pouch. In some embodiments, one or more magnetized projectiles/pellets/shot elements may be used and temporarily held or "attracted" to a non-magnetized pouch element. Among the many other alternative embodiments are those using both magnetized projectiles and one or more magnets in the pouch. Persons of ordinary skill in the art will understand that only some of the shot elements could be magnetized, and those magnetized pieces could attract other non-magnetized shot elements (into a "clump" of shot) and also hold the "clump" to the pouch temporarily prior to shooting, as described herein.

Although the method of the present invention is described with steps occurring in a certain order, the specific order of the steps, or any continuation or interruption between steps, is not required.

The apparatus and methods of the present invention have been described with some particularity, but the specific designs, constructions and steps disclosed are not to be taken as delimiting of the invention. Obvious modifications will make themselves apparent to those of ordinary skill in the art, all of which will not depart from the essence of the invention and all such changes and modifications are intended to be encompassed within the appended claims.

What is claimed is:

1. A slingshot apparatus, including a frame member, a pouch, and an energy-storing and releasing member acting between the frame member and the pouch, said pouch comprising a magnetic force element capable of attracting ammunition to the pouch prior to launch of the ammunition by the slingshot apparatus, and at least one piece of ammunition that itself is magnetized.

2. The apparatus of claim 1, in which said magnetic force element comprises a magnetized element held within a pocket formed on said pouch.

3. The apparatus of claim 1, in which said magnetic force element comprises the body of said pouch being formed substantially from a flexible magnetic sheet.

4. The apparatus of claim 1, in which said magnetic force element comprises a flexible magnetic sheet portion operatively affixed to a non-magnetized portion of said pouch.

5. A pouch and a shot element for a slingshot, including a magnetized element operatively associated with said pouch, and at least one magnetized shot element attracted thereto.

6. Apparatus for shooting projectiles, including a handheld frame, an energy-storing and releasing member, a pouch, at least one magnetized projectile member, and attraction means acting between the pouch and the magnetized projectile member.

7. Apparatus for shooting magnetized projectiles, including a handheld frame, a strap stretchably connected to said frame and having at least one non-magnetized attracting portion positioned along the length of the strap to attract and temporarily retain at least one magnetized projectile member toward said strap, and at least one magnetized projectile member.

8. The apparatus of claim 7, further including a magnetized attracting portion.

9. Apparatus for shooting magnetized projectiles, including at least one magnetized projectile member, a handheld frame, a strap stretchably connected to said frame and having at least one non-magnetized attracting portion positioned along the length of the strap to attract and temporarily retain at least one magnetized projectile member toward said strap, in which said attracting portion is a material capable of being attracted by the at least one magnetized projectile member.

10. A system for shooting ammunition by human power, including at least one magnetized shot element, a slingshot assembly, said slingshot assembly having a pouch portion having a magnetically charged element therein to attract and temporarily hold the shot in a desired position until the user fires the slingshot.

11. A system for shooting ammunition by human power, including at least one piece of magnetized shot, a slingshot assembly, said slingshot assembly having a pouch portion having a non-magnetically-charged element therein to attract and temporarily hold the shot in a desired position until the user fires the slingshot.

12. A system for shooting ammunition by human power, including at least one piece of magnetized shot, and a slingshot assembly, said slingshot assembly having a pouch portion having a magnetically charged element therein to attract and temporarily hold the shot in a desired position until the user fires the slingshot.

13. The process of shooting ammunition, including the steps of providing the system of claim 10 or claim 12;

temporarily holding the magnetized shot adjacent said pouch portion; and firing said slingshot assembly so that said shot is released from the pouch.

14. Magnetized shot for use in a slingshot, including at least one piece of shot sized ammunition to be received and temporarily held in a slingshot pouch, said shot charged with a magnetic force that is both sufficiently large to retain the shot against a slingshot pouch having a magnetically-mating element therein and sufficiently small to allow the shot to release from the pouch during normal application and release of force in shooting the slingshot.

15. A pouch and magnet combination, including a pouch member sized and configured to hold magnetic ammunition, said pouch configured to be assembled with and actuated by a slingshot frame and an associated energy storing/releasing member, said magnet operatively retained with said pouch by a magnetic force that is (a) sufficiently large to retain said ammunition against the pouch and (b) sufficiently small to facilitate release of the ammunition from the pouch during normal application and release of force in operating the slingshot.

* * * * *